US009222757B2

(12) United States Patent
Seuk

(10) Patent No.: US 9,222,757 B2
(45) Date of Patent: Dec. 29, 2015

(54) BODY ARMOR BALLISTIC PLATE CARRIER

(76) Inventor: Jo Won Seuk, Highland Falls, NY (US)

( * ) Notice: Subject to any disclaimer, the term of this patent is extended or adjusted under 35 U.S.C. 154(b) by 0 days.

(21) Appl. No.: 12/927,975

(22) Filed: Nov. 30, 2010

(65) Prior Publication Data

US 2012/0132065 A1 May 31, 2012

(51) Int. Cl.

| | |
|---|---|
| ***F41H 1/02*** | (2006.01) |
| ***F41H 1/04*** | (2006.01) |
| ***A41D 1/04*** | (2006.01) |
| ***A41D 27/26*** | (2006.01) |
| ***A41D 13/00*** | (2006.01) |
| *A41D 13/05* | (2006.01) |

(52) U.S. Cl.

CPC ..... *F41H 1/02* (2013.01); *A41D 13/0012* (2013.01); *A41D 13/0518* (2013.01); *A41D 13/0531* (2013.01)

(58) Field of Classification Search

CPC ..... F41H 1/00; F41H 1/02; A41D 1/04; A41D 13/00; A41D 13/0012; A41D 13/05; A41D 13/0512; A41D 13/0518; A41D 13/0531; Y10S 2/908; Y10S 2/912; Y10S 2/92

USPC ..... 2/2.5, 44, 45, 69, 102, 455, 456, 459, 2/460, 461, 462, 463, 464, 465, 467, 2/252–254; 224/255, 259; 89/36.05

See application file for complete search history.

(56) References Cited

U.S. PATENT DOCUMENTS

| | | | | | |
|---|---|---|---|---|---|
| 1,887,473 | A | * | 11/1932 | Warner | 2/462 |
| 3,452,362 | A | * | 7/1969 | Korolick et al. | 2/2.5 |
| 3,891,996 | A | * | 7/1975 | Leach et al. | 2/2.5 |
| 3,958,276 | A | * | 5/1976 | Clausen | 2/2.5 |
| 5,022,092 | A | * | 6/1991 | Bombrini | 2/94 |
| 5,060,314 | A | * | 10/1991 | Lewis | 2/2.5 |
| 5,431,318 | A | * | 7/1995 | Garcia | 224/192 |
| 5,606,744 | A | * | 3/1997 | Lindy | 2/467 |
| 5,799,851 | A | * | 9/1998 | Wulf et al. | 224/583 |
| 2005/0010987 | A1 | * | 1/2005 | Crye et al. | 2/2.5 |
| 2009/0209894 | A1 | * | 8/2009 | McAllister | 602/19 |
| 2009/0282595 | A1 | * | 11/2009 | Branson et al. | 2/2.5 |
| 2010/0088799 | A1 | * | 4/2010 | Carter | 2/102 |
| 2010/0205718 | A1 | * | 8/2010 | Eastep | 2/102 |
| 2013/0042376 | A1 | * | 2/2013 | Hexels | 2/2.5 |

* cited by examiner

*Primary Examiner* — Alissa L Hoey
*Assistant Examiner* — Jameson Collier
(74) *Attorney, Agent, or Firm* — R. Tracy Crump

(57) ABSTRACT

The present plate carrier includes front and rear panel sections with internal pockets for supporting ballistic plates and inserts, but positions the rear panel section to provide improved thoracic protection. The front and rear panel sections are suspended by shoulder straps, which connect to the rear panel section at a mid point below the top edge of the rear panel section. The mid point connection of the shoulder straps causes the rear panel section to ride higher than the front panel section and higher on the wearer's back thereby positioning the ballistic plate inside high on the wearer's back and providing better ballistic coverage of the wearer's upper thoracic area. One of the internal pockets of each panel section has facing strips of hook and loop material sewn around its inner periphery that adhere together around a ballistic plate to center and hold the plate in place within the pocket.

3 Claims, 10 Drawing Sheets

BODY ARMOR BALLISTIC PLATE CARRIER

This invention relates to ballistic resistant "body armor" and in particular, a plate carrier for rigid ballistic plates and flexible ballistic inserts.

BACKGROUND AND SUMMARY OF THE INVENTION

Body armor and particularly "plate carriers" are well known in the military and law enforcement communities. Plate carriers are garments that support rigid ballistic armor plates and/or flexible ballistic armor inserts within internal pockets or pouches of the carrier. The plate carrier is generally comprised of front and back panel sections connected by shoulder straps and a waist strap or cummerbund. Generally, conventional plate carriers are not sized and proportioned for particular wearers but to accommodate the sizes of inserts and armor plates, which are typically available in small, medium, large and extra large sizes. Consequently, conventional plate carriers have suffered from issues relating to the proper fit of the plate carrier to the individual wearer. Ideally, a plate carrier must properly position and secure the plates to adequately cover the wearer's vital areas, while accommodating the various sizes of plates and inserts. One common issue with conventional plate carriers is the position and height of the rear plate on the wearer's back. Because the front and back panels are suspended from shoulder straps, the rear panel often does not ride high enough on the wearer's back to provide adequate thoracic protection. In addition, because the armor plates and inserts are simply carried within internal pockets or pouches within the panel sections, smaller plates and inserts often shift about within the pockets as the wearer moves.

The present invention provides a plate carrier that includes both front and rear panel sections with internal pockets for supporting armor plates and inserts, but positions the rear panel section to provide improved thoracic protection. The front and rear panel sections are suspended by shoulder straps, which connect to the rear panel section at a mid point below the top edge of the rear panel section. The mid point connection of the shoulder straps causes the rear panel section to ride higher than the front panel section and higher on the wearer's back thereby positioning the armor plate inside high on the wearer's back and providing better ballistic coverage of the wearer's upper thoracic area. One of the internal pockets of each panel section has facing strips of hook and loop material sewn around its inner periphery that adhere together around an armor plate to center and hold the plate in place within the pocket.

Various advantages of the present invention will become apparent from the following description of an embodiment of the invention with reference to the accompanying drawings.

BRIEF DESCRIPTION OF THE DRAWINGS

The drawings illustrate an embodiment of the present invention, in which.

DESCRIPTION OF THE PREFERRED EMBODIMENT

Figure 1:
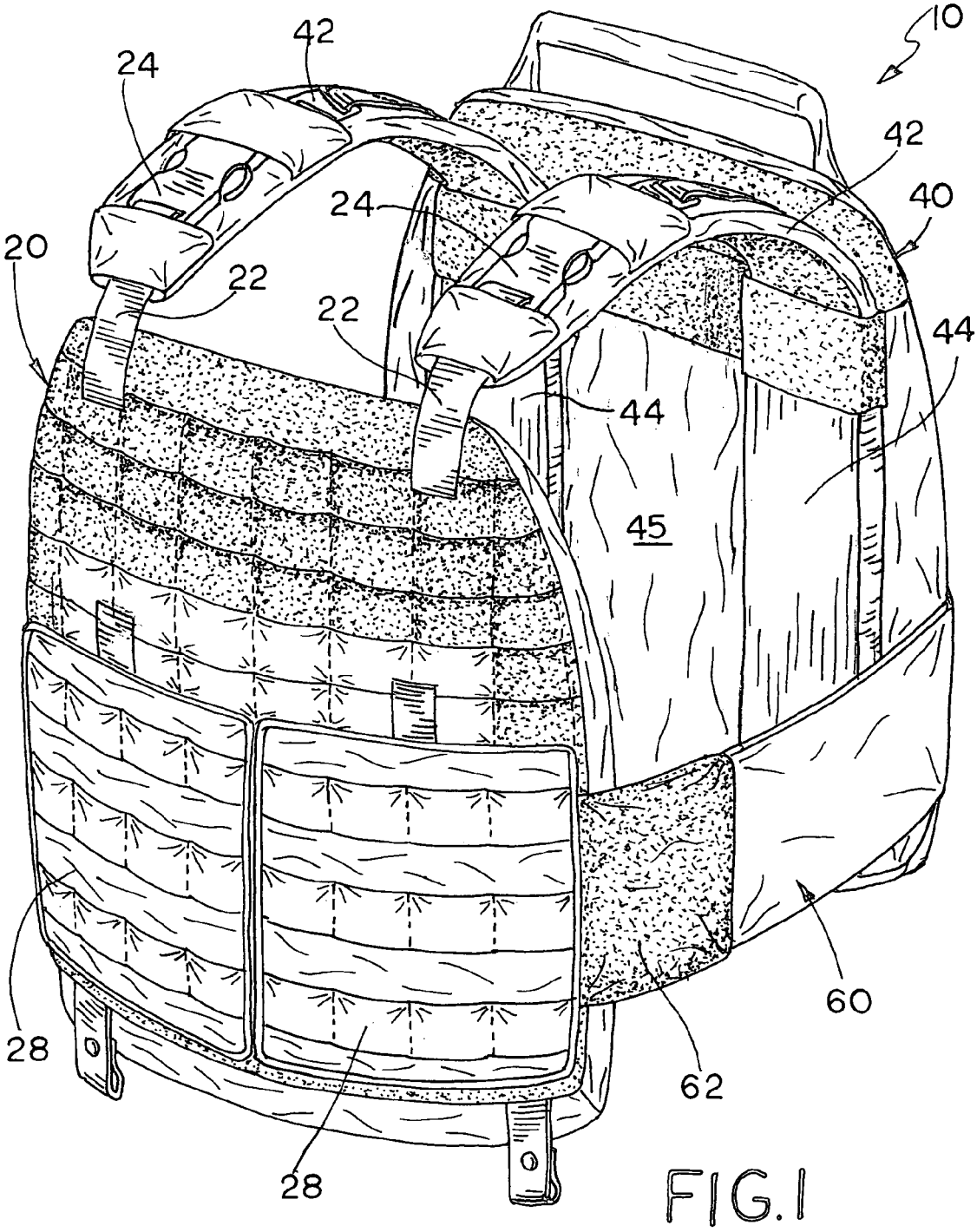
FIG. 1 is a perspective view of an embodiment of the body armor plate carrier of the invention.
Figure 2:
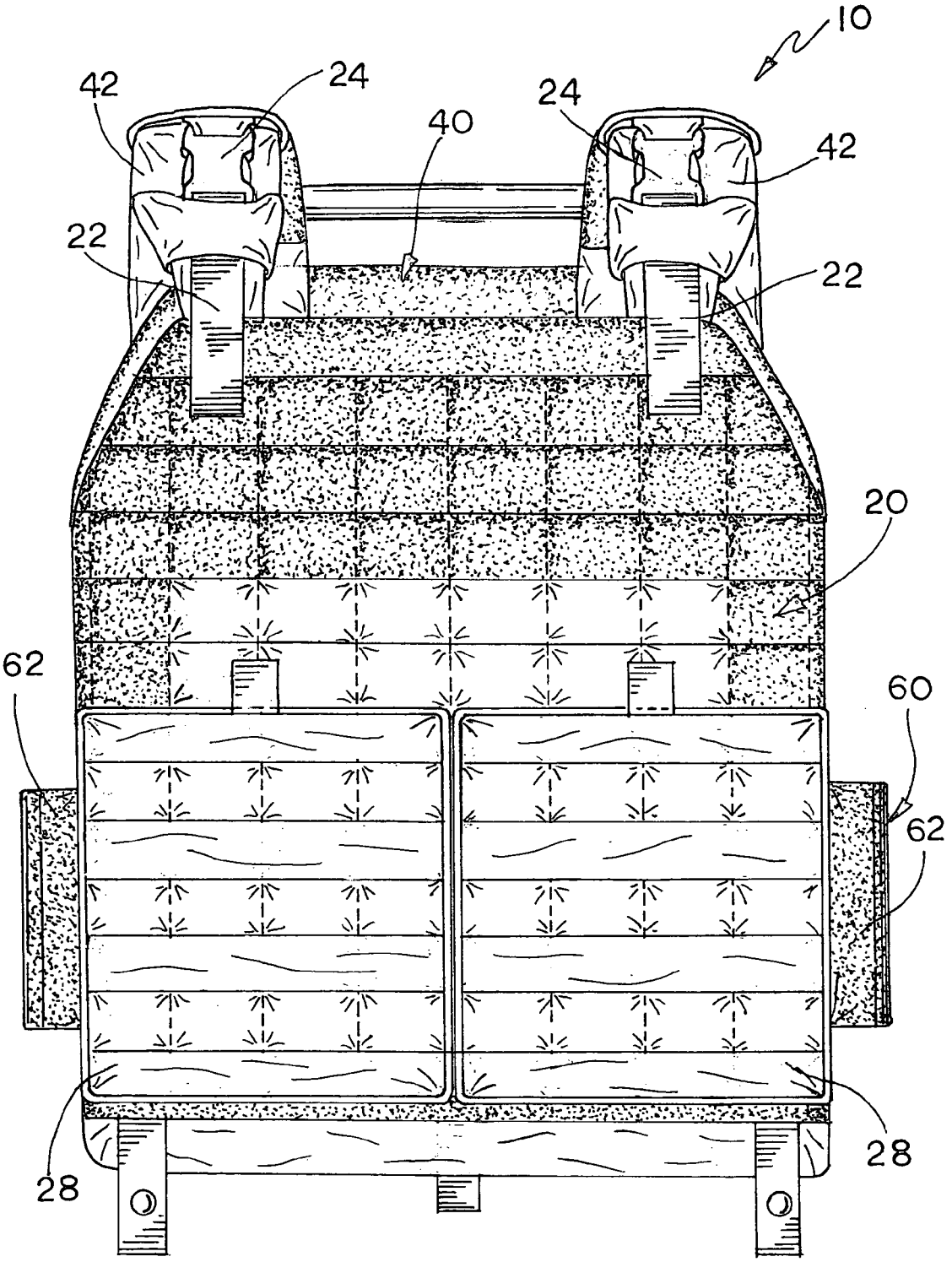
FIG. 2 is a front view of the plate carrier of FIG. 1.
Figure 3:
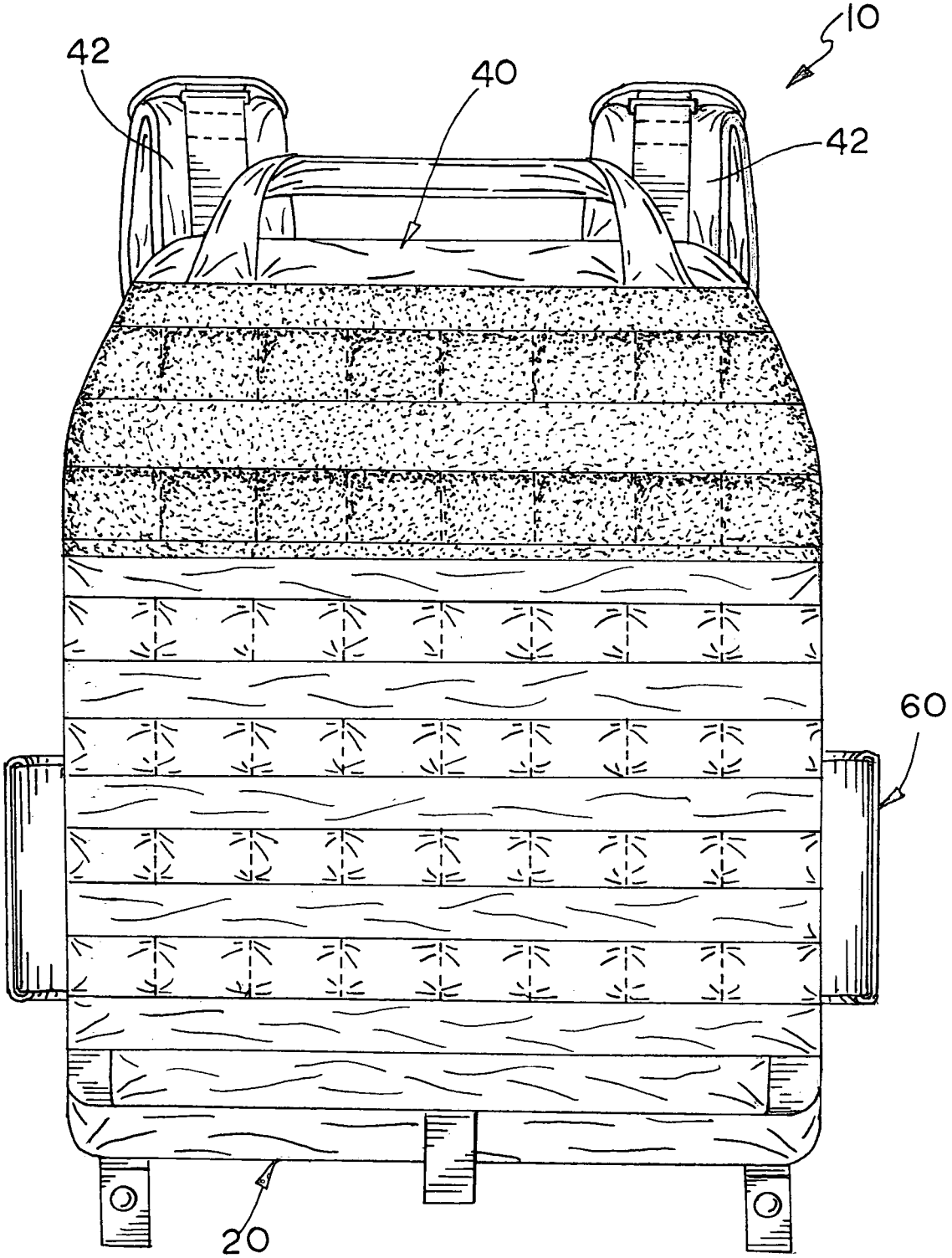
FIG. 3 is a rear view of the plate carrier of FIG. 1.

Referring now to the drawings, FIGS. 1-11 illustrate an embodiment of the plate carrier of the present invention, which is designated generally as reference numeral 10. Plate carrier 10 includes a front panel section 20, a rear panel section 40 and a detachable cummerbund 60. The materials and manner of construction of plate carrier 10 are readily known in the art and will not be described in detail herein; however, plate carrier 10 is sewn and constructed generally of nylon fabrics, such as Cordura® from INVISTA, but can be made from any natural or synthetic cloth or fabric, which resists tears, abrasions and scuffs. The weight of the fabric for the pouch body is selected to provide sufficient rigidity to support the ballistic armor plates and inserts but also any external equipment that may be affixed to the plate carrier. Straps of elastic and nylon webbing are also used in the construction of plate carrier 10 for various components and feature. Hook and loop fasteners, such as Velcro® are used in various places to secure and interconnect various flaps, closures and components; however, other types of fasteners, such as, snaps, buttons, frogs, clips, ties and pins may be used in place of the hook and loop materials without deviating from the teaching of this invention. Similarly, quick connect buckles and fasteners are used to connect and secure straps and webbing, but other types of fasteners may be used instead.

As shown, the front and rear panel sections 20 and 40 are covered in PALS (Pouch Attachment Ladder System) webbing to be MOLLE (MOdular Lightweight Load-carrying Equipment) compatible. The PALS webbing allows the pouches to be attached to other MOLLE compatible vests, packs and pouches. PALS webbing consists of horizontal rows of heavy-duty 1" nylon webbing. PALS webbing allows the pouches to be quickly attached to other MOLLE compatible vests, packs and pouches using "Natick" snaps (polyethylene reinforced webbing straps with push the dot snaps for security) or polymer MALICE Clips® from Tactical Tailor (not shown). Different areas of the PALS webbing may use braided nylon webbing, while others use hook and loop webbing for enhanced utility. The type, placement and arrangement of the PALS webbing may vary. In addition, some of the PALs webbing may be formed from hook and loop webbing so that hook and loop attachments may be directly mounted to the surface of the carrier sections.

Figure 4:
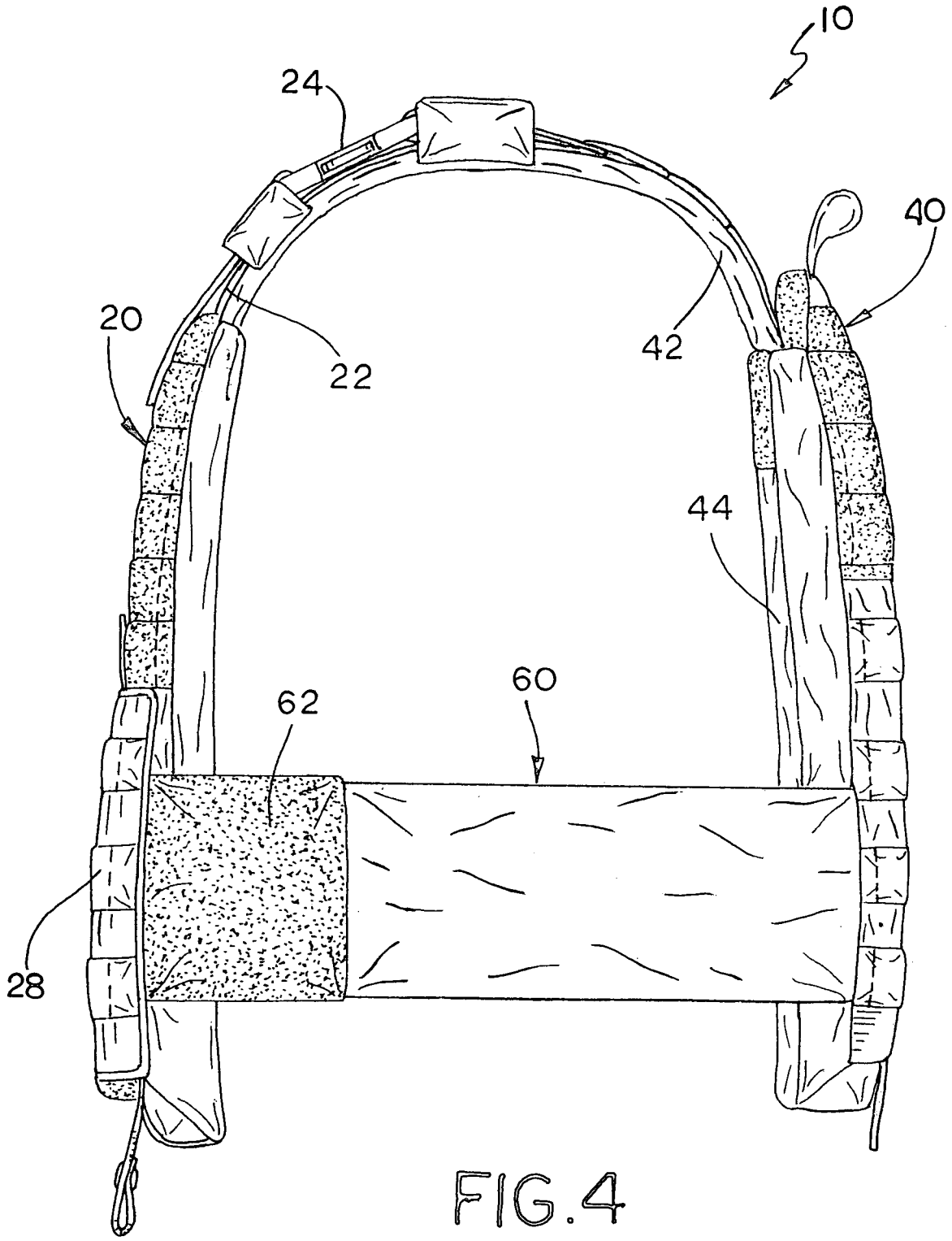
FIG. 4 is a left side view of the plate carrier of FIG. 1.
Figure 5:
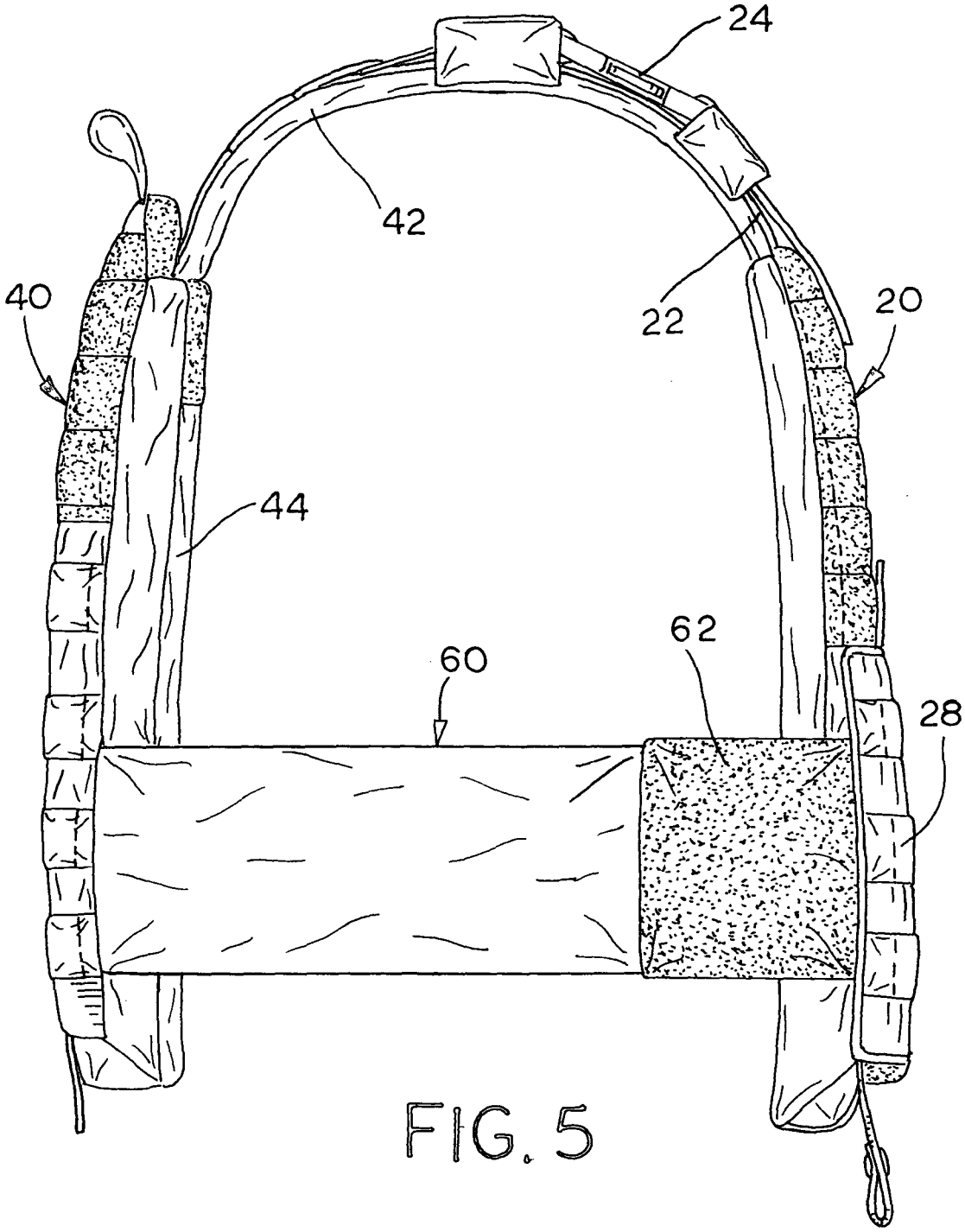
FIG. 5 is a right side view of the plate carrier of FIG. 1.
Figure 6:
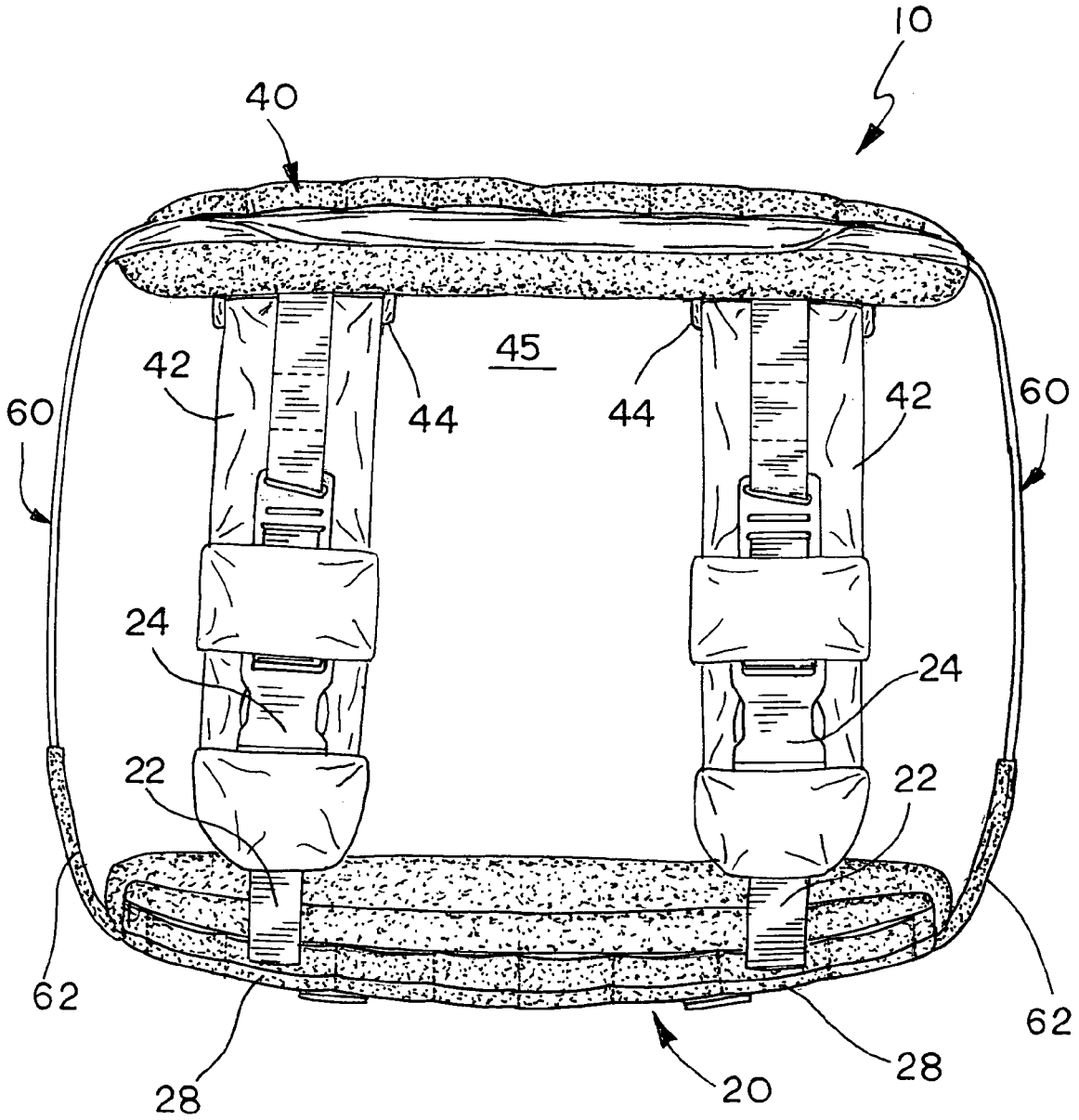
FIG. 6 is a top view of the plate carrier of FIG. 1.

Rear panel section 40 includes a pair of padded shoulder straps 42. Front carrier section 20 also has a pair of shoulder straps 22 formed by lengths of nylon webbing, which extend from the top edge of the front carrier body. As shown, shoulder straps 22 and padded shoulder straps 42 are connected by quick connect buckles 24, but may be connected by D-rings or other fasteners. While front shoulder straps 22 extend from the top edge of front carrier section 20, padded shoulder straps 42 extend from a mid point on the rear carrier section's inner face. As best shown in FIGS. 4 and 5, the connection point of padded shoulder straps 42 on the rear panel section 40 causes rear panel section 40 to ride higher than the front carrier section when worn. Rear panel section 40 rides higher on the wearer's back thereby positioning the armor plate inside high on the wearer's back and providing better ballistic coverage of the wearer's upper thoracic area. Typically, the rear panel section 40 remains substantially upright and extends above the wearer's scapula as shoulder straps 42 arc forward over the wearer's shoulders. As best shown in FIG. 1, padded shoulder straps 42 connect and merge with two vertical rows of back padding 44, which are spaced apart to form a protective spinal channel 45. When plate carrier 10 is worn, only back padding 44 contacts the wearer's back and the wearer's spine is protected within central spinal channel 45. The spinal channel 45 also provides improved ventilation under rear panel section 40.

Detachable Cummerbund 60 wraps around the wearer and secures the rear panel section 40 to the front panel section 20. Cummerbund 60 is constructed of a length of elastic webbing with hook and loop patches sewn to its ends. The elastic webbing gives cummerbund 60 sufficient elasticity for freedom of movement, while holding front and rear carrier section snugly against the wearer's body. Other embodiments of cummerbund 60 may include PAL webbing (not shown) for additional load carrying capacity or replace the elastic webbing with other elastic materials such as elastic cord. Cummerbund 60 pass through a lateral sleeve (not shown) in rear panel section 40 and is detachably secured within the sleeve by patches of hook and loop fasteners (not shown) and sewn to the cummerbund 60 and the inside of the lateral sleeve. The ends of cummerbund 60 are held to front panel section 20 by hook and loop material 26 on the outer face of the front carrier plate and hook and loop material 62 on either side of the cummerbund. When secured, the ends of cummerbund 60 are covered by two cover flaps 28 sewn to the outer face of front carrier section 20.

As shown in FIGS. 7-10, each of the front and rear panel sections 20 and 40 has a pair of internal pockets 31 and 33 within which rigid ballistic armor plates 4, flexible ballistic armor inserts 2 or non-ballistic pads are carried. Plate carrier 10 is designed to be adapted within the teaching of this invention for use with conventional rigid ballistic armor plates and ballistic armor inserts, which are well known in the art and will not be described in detail, herein. The shapes of front and rear panel sections 20 and 30 are selected to accommodate the shape of conventional rigid armor plates and accompanying flexible armor inserts. Plate pockets 31 and 33 have open bottoms through which the various armor plates, armor inserts or removable non-ballistic pads are inserted. The plates, inserts and removable pads are held within pockets 31 and 33 by flaps 32 and 34, which secure to the interior walls of the pockets using hook and loop material 35 sewn to the inside pocket walls and patches of hook and loop fasteners 36 sewn to the flaps. Flaps 32 and 34 prevent dirt and debris from entering pockets 31 and 33 and allow the plates, inserts and pads to be easily removed and replaced.

Figure 7:
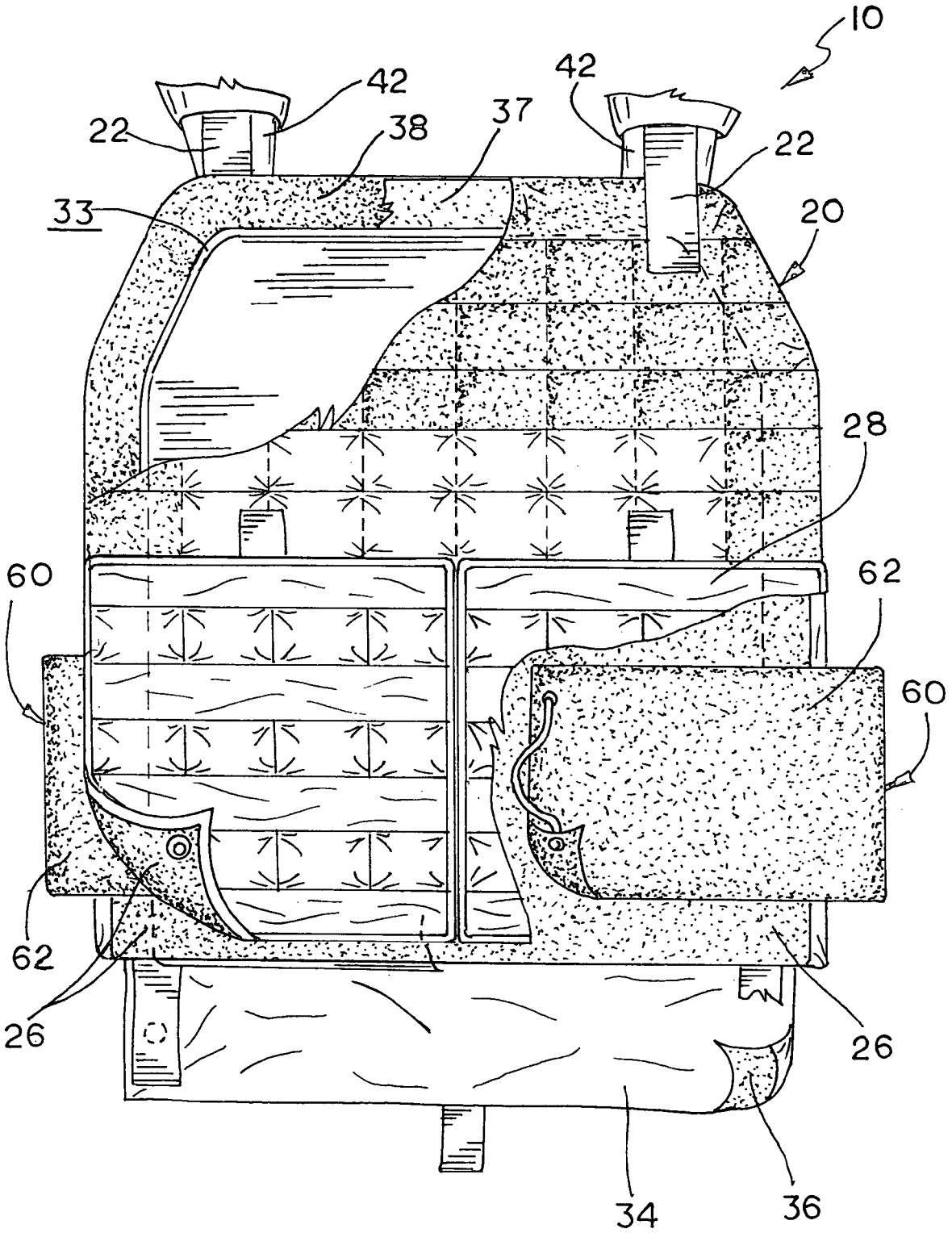
FIG. 7 is a front view of the plate carrier of FIG. 1 with portions cut away.
Figure 8:
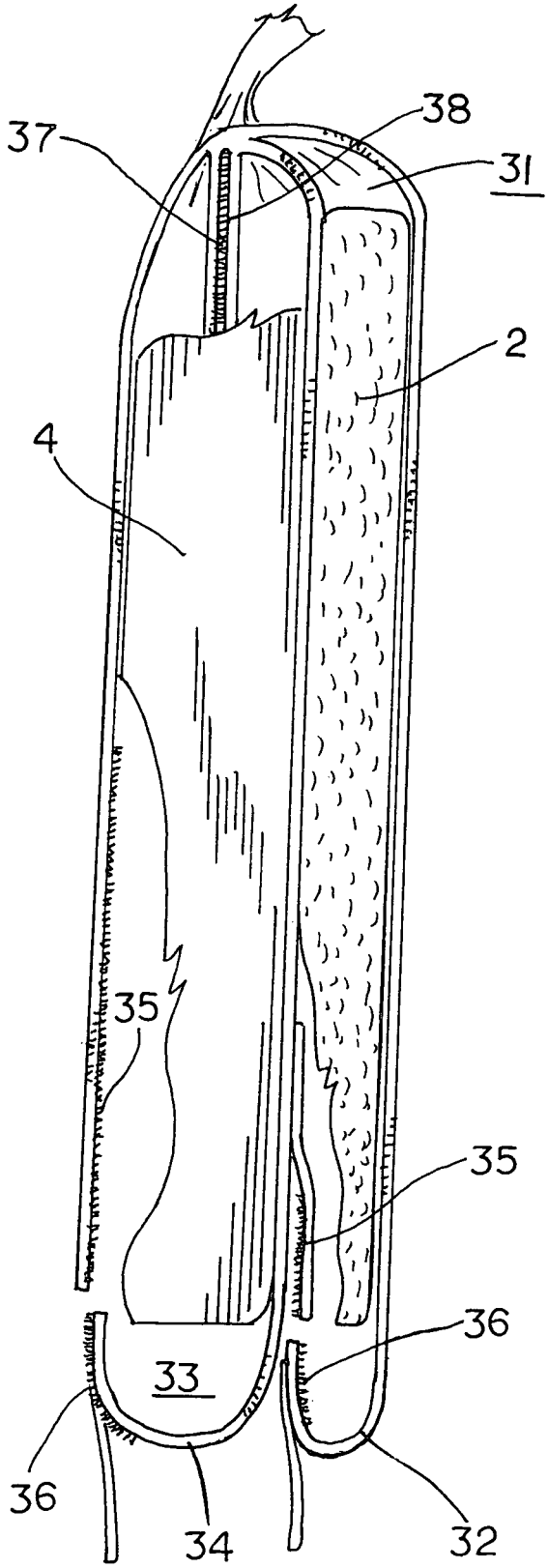
FIG. 8 is a partial side sectional view of one of the plate carrier sections.
Figure 9:
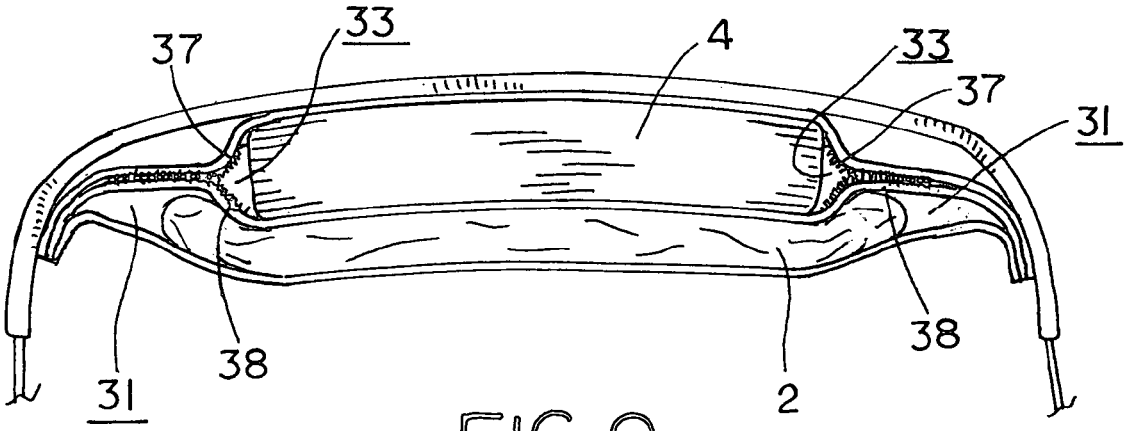
FIG. 9 is a partial top sectional view of one of the plate carrier sections with a small armor plate.
Figure 10:
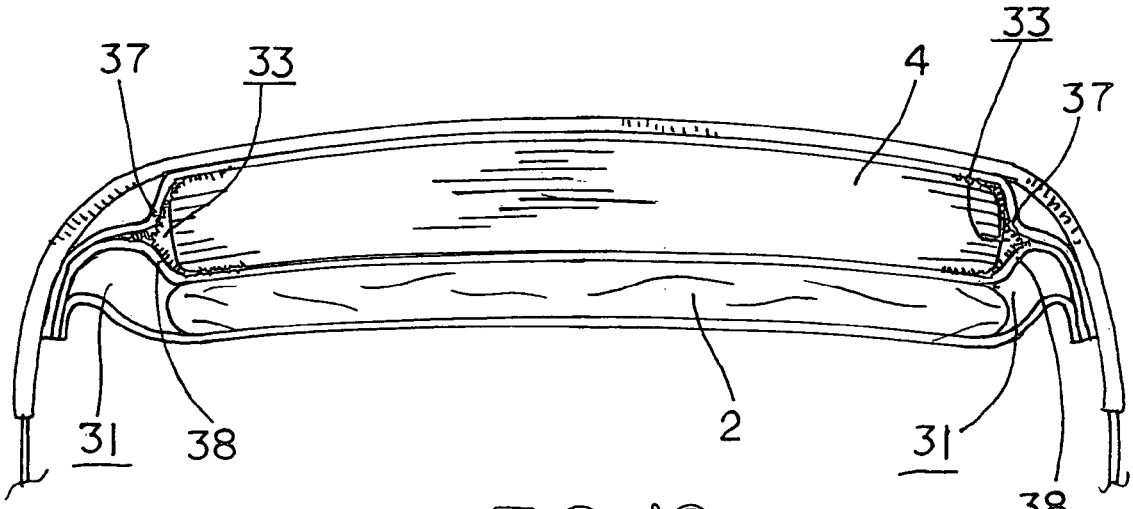
FIG. 10 is a partial top sectional view of one of the plate carrier sections with a large armor plate.
Figure 11:
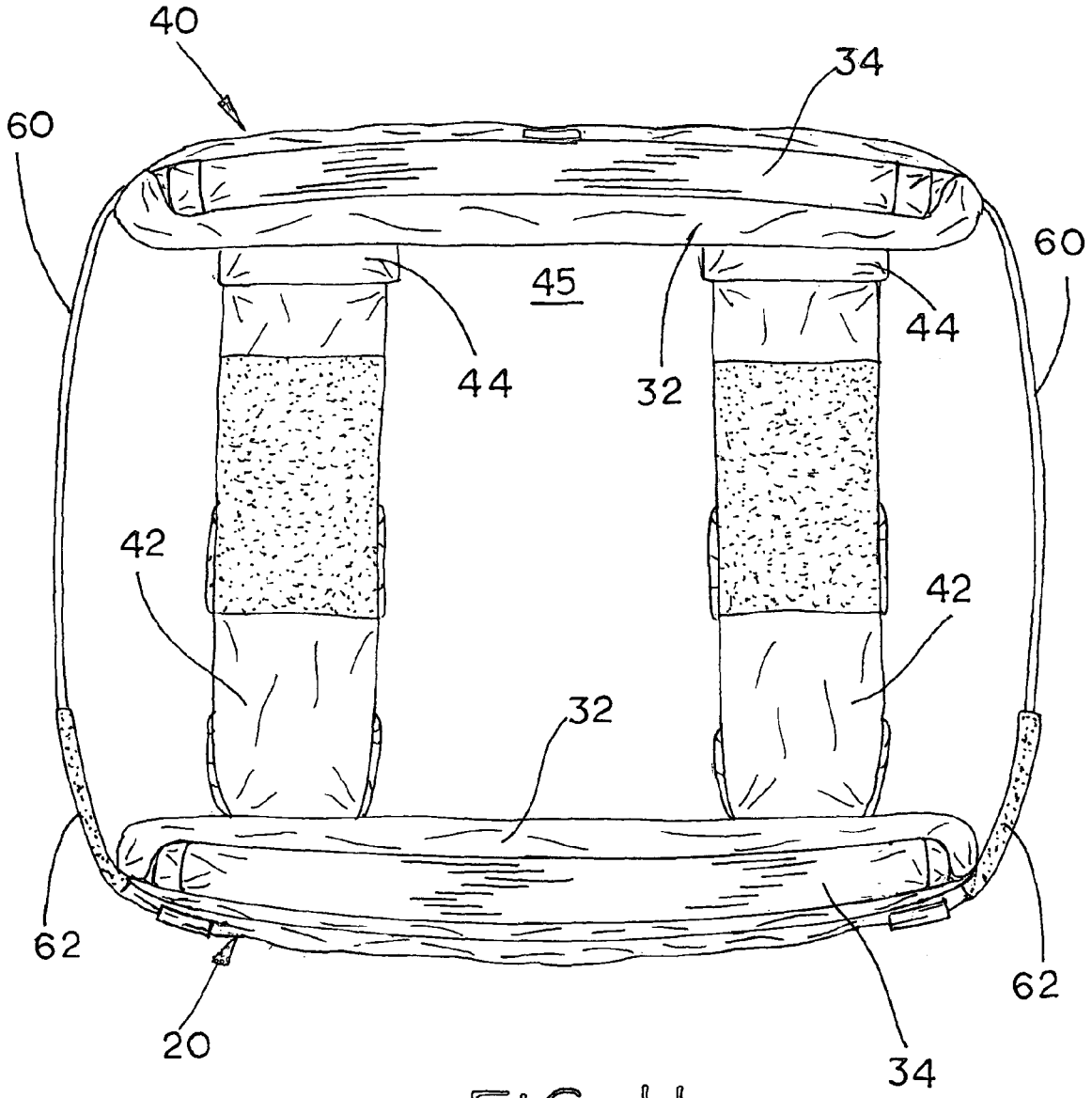
FIG. 11 is a bottom view of the plate carrier for FIG. 1.

Inner pocket 31 is designed to accommodate a flexible ballistic armor insert 2 or a foam pad (not shown). The use of soft armor inserts provides enhanced ballistic protection, while the use of an additional foam pad provides increased wearer comfort. It should be understood that plate carrier 10 can be used and worn without any of the armor plates, inserts or pads. Outer pocket 33 is designed to accommodate rigid ballistic armor plates 4. As best shown in FIG. 7, outer pocket 33 includes facing strips of hook and loop material 37 and 38 sewn around its inner periphery. Facing strips of hook and loop material 37 and 38 adhere together around the edges of armor plate 4 to center and hold the armor plate within outer pocket 33. The width of peripheral facing strips of hook and loop material 37 and 38 allows outer pocket 33 to accommodate plates of different sizes. As shown in FIGS. 9 and 10, different sized plates can be inserted in outer pocket 33 with peripheral facing strips of hook and loop material 37 and 38 separated to receive larger sized plates and the edges "pinching" together to adhere around smaller sized plates. Regardless of the plate size, the peripheral facing strips of hook and loop material 37 and 38 prevent the movement of plate 4 within outer pocket 33.

One skilled in the art will note that the plate carrier of this invention provides improved upper thoracic protection, as well as improved wearer comfort. The mid point connection of the rear shoulder straps on the rear panel section allows the rear panel section to ride higher on the wearer's back so that the armor plate covers more of the vital upper thoracic area. It should be noted that conventional wisdom in backpack and load bearing garment design tends to desire to distribute and support the weight of the load lower on the wearer's back and across the wearer's hips. By contrast, the plate carrier of this invention positions and supports the weight of the rear panel section higher on the wearer's back to improve ballistic protection to the upper thoracic area. While the mid point connection of the shoulder straps on the rear panel section shifts the weight of the plates and inserts higher on the wearer's back, the weight is not unnatural or uncomfortable. The mid point connection of the shoulder strap to the rear panel section also allows for greater freedom of movement. The rear panel section remains substantially upright with the lower portion of the rear panel section abutting the wearer's mid back and the upper portion of the rear panel section elevated above the wearer's scapulas. Because of the mid point connection of the shoulder straps to the rear section, bending forward or backward will not cause the top or bottom of the rear section to flare outward from the wearer's back. The two spaced rows of back padding and central spinal channel also provides enhanced wearer comfort and ventilation.

The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A body armor ballistic plate carrier comprising:

a front armor ballistic plate;

a rear armor ballistic plate; and a ballistic plate carrier adapted to be worn by a user to support the front armor ballistic plate and rear armor ballistic plate over the user's torso, the ballistic plate carrier includes a front panel section adapted to overlie the front of a user's torso; a rear panel section adapted to overlie the back of a user's torso; and a pair of shoulder straps connected to the front panel section and the rear panel section thereby configured to suspend the ballistic plate carrier from the user's shoulders, each of the front armor ballistic plate and the rear armor ballistic plate have a top peripheral plate edge, each of the front panel section and the rear panel section has a top peripheral panel edge thereof and an internal pocket therein, the front armor ballistic plate is removably disposed within the internal pocket of the front panel section so that the top peripheral plate edge sits adjacent the top peripheral edge of the front panel section, the rear armor ballistic plate is removably disposed within the interior pocket of the rear panel section so that the top peripheral plate edge sits adjacent the top peripheral edge of the rear panel section, each of the front panel section and the rear panel section also having an inner panel sheet and an outer panel sheet defining the internal pocket thereof, the inner panel sheet of each of the front panel section and the rear panel section adapted to lay against the user's torso when donned, each of the pair of shoulder straps having a first strap end part attached to the top peripheral panel edge of the front panel section and a second strap end part attached to the inner panel sheet of the rear panel section at a location spaced away from and below the top peripheral panel edge of the rear panel section so that the top peripheral plate edge of the rear armor ballistic plate disposed within the internal pocket of the rear panel section rides higher on the user's torso than the top peripheral plate edge of the front armor ballistic plate disposed within the internal pocket of the front panel section when the ballistic carrier is donned by the user.

2. The body armor ballistic plate carrier of claim 1 wherein the respective inner and outer panel sheets of each of the front and rear panel sections overlie each other and are joined together along the entire length of three adjacent corresponding sides thereof, the internal pocket of at least one of the front panel section and the rear panel section includes facing strips of hook and loop material mounted respectively to the inner panel sheet and the outer panel sheet within the internal pocket and extending along the length of the three adjacent corresponding sides thereof so that the engagement of the facing strips of hook and loop material prevents one of the front armor ballistic plate and the rear armor ballistic plate from shifting within the internal pocket.

3. The body armor ballistic plate carrier of claim 1 wherein the inner panel sheet of the rear panel section includes two elongated rows of back padding extending from the inner panel surface, the two rows of back padding are spaced parallel from each other to define a central channel therebetween thereby the two rows of back padding contact the user's torso and the user's spine is protectively received within the central channel when the carrier is donned by the user.

* * * * *